US006474633B1

(12) United States Patent
Hirai

(10) Patent No.: US 6,474,633 B1
(45) Date of Patent: Nov. 5, 2002

(54) STAPLER WITH INTERCHANGEABLE CARTRIDGES

(75) Inventor: Katsuaki Hirai, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 09/672,771

(22) Filed: Sep. 29, 2000

(30) Foreign Application Priority Data

Oct. 4, 1999 (JP) ..... 11-282599

(51) Int. Cl.[7] ..... B65H 37/04; B27F 7/38

(52) U.S. Cl. ..... 270/58.09; 227/119; 227/120; 221/197

(58) Field of Search ..... 270/58.07, 58.08, 270/58.09; 227/2, 5, 109, 119, 120; 221/197, 198

(56) References Cited

U.S. PATENT DOCUMENTS

| | | | | |
|---|---|---|---|---|
| 4,421,264 A | * | 12/1983 | Arter et al. | 227/2 |
| 4,878,656 A | * | 11/1989 | Honjo et al. | 270/37 |
| 5,354,042 A | * | 10/1994 | Coombs | 227/5 |
| 5,464,201 A | * | 11/1995 | Deen et al. | 227/5 |
| 5,573,233 A | | 11/1996 | Hirai et al. | 270/58.08 |
| 5,735,515 A | | 4/1998 | Hayashi et al. | 270/58.11 |
| 5,897,250 A | | 4/1999 | Hirai et al. | 399/404 |
| RE36,923 E | * | 10/2000 | Hiroi et al. | 227/2 |

FOREIGN PATENT DOCUMENTS

| | | | |
|---|---|---|---|
| JP | 3-25931 | | 6/1991 |
| JP | 8-268640 | | 10/1996 |
| JP | 10-80877 | * | 3/1998 |
| JP | 11-99505 | * | 4/1999 |
| JP | 11-322176 | * | 11/1999 |
| JP | 2000-86073 | * | 3/2000 |

* cited by examiner

*Primary Examiner*—Christopher P. Ellis
*Assistant Examiner*—Patrick Mackey
(74) *Attorney, Agent, or Firm*—Fitzpatrick, Cella, Harper & Scinto

(57) ABSTRACT

A stapler unit comprises a stapler provided with a stapling device for stapling a sheet stack, and a staple cartridge arrangement detachably loaded on the stapler and provided with a staple receiving device for receiving staples. A plurality of the staple cartridges for receiving staples having a plurality of lengths are provided in the staple cartridge arrangement, and each of the receiving devices of the plurality of staple cartridges is provided with a guide for controlling, when the staple cartridge is loaded, staples received therein so that the longitudinal centers of the staples are positioned at the same positions as those of the staples having other lengths.

10 Claims, 21 Drawing Sheets

FIG. 4

| | | | | |
|---|---|---|---|---|
| SW1 OUTPUT | ON | ON | OFF | OFF |
| SW2 OUTPUT | ON | OFF | ON | OFF |
| DETECTED CARTRIDGE | B | A | C | NIL |
| PERMISSIBLE SHEET-QUANTITY TO BE STAPLED | 60 SHEETS | 100 SHEETS | 20 SHEETS | – |

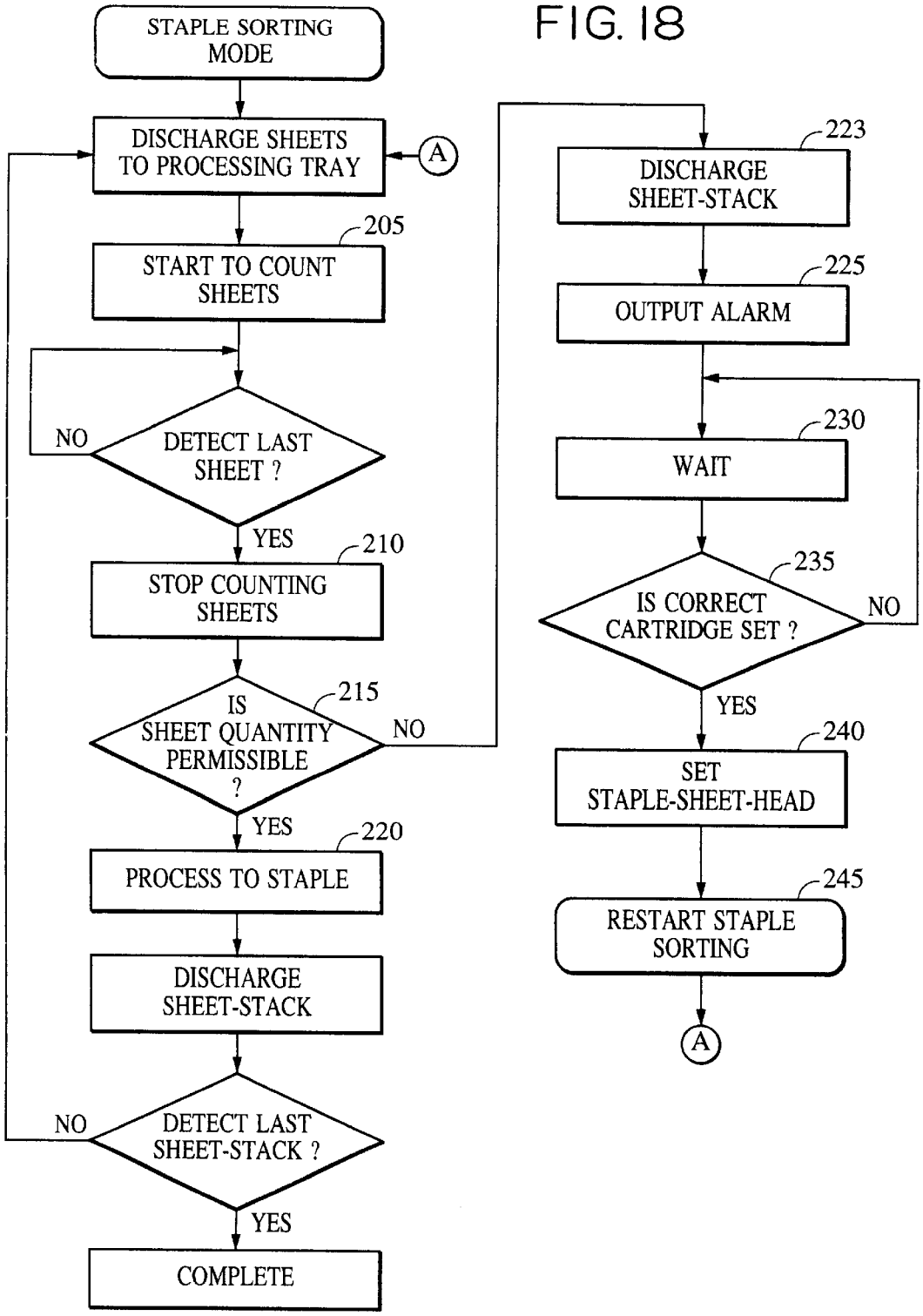
FIG. 18
STAPLE SORTING MODE
DISCHARGE SHEETS TO PROCESSING TRAY
A
205
START TO COUNT SHEETS
NO
DETECT LAST SHEET ?
YES
210
STOP COUNTING SHEETS
215
IS SHEET QUANTITY PERMISSIBLE ?
NO
YES
220
PROCESS TO STAPLE
DISCHARGE SHEET-STACK
NO
DETECT LAST SHEET-STACK ?
YES
COMPLETE
223
DISCHARGE SHEET-STACK
225
OUTPUT ALARM
230
WAIT
235
IS CORRECT CARTRIDGE SET ?
NO
YES
240
SET STAPLE-SHEET-HEAD
245
RESTART STAPLE SORTING
A

FIG. 19

| | | | | |
|---|---|---|---|---|
| SW1 OUTPUT | ON | ON | OFF | OFF |
| SW2 OUTPUT | ON | OFF | ON | OFF |
| DETECTED CARTRIDGE | B | A | C | NIL |
| PERMISSIBLE SHEET-QUANTITY TO BE STAPLED | 21 TO 60 SHEETS | 61 TO 100 SHEETS | 2 TO 20 SHEETS | – |

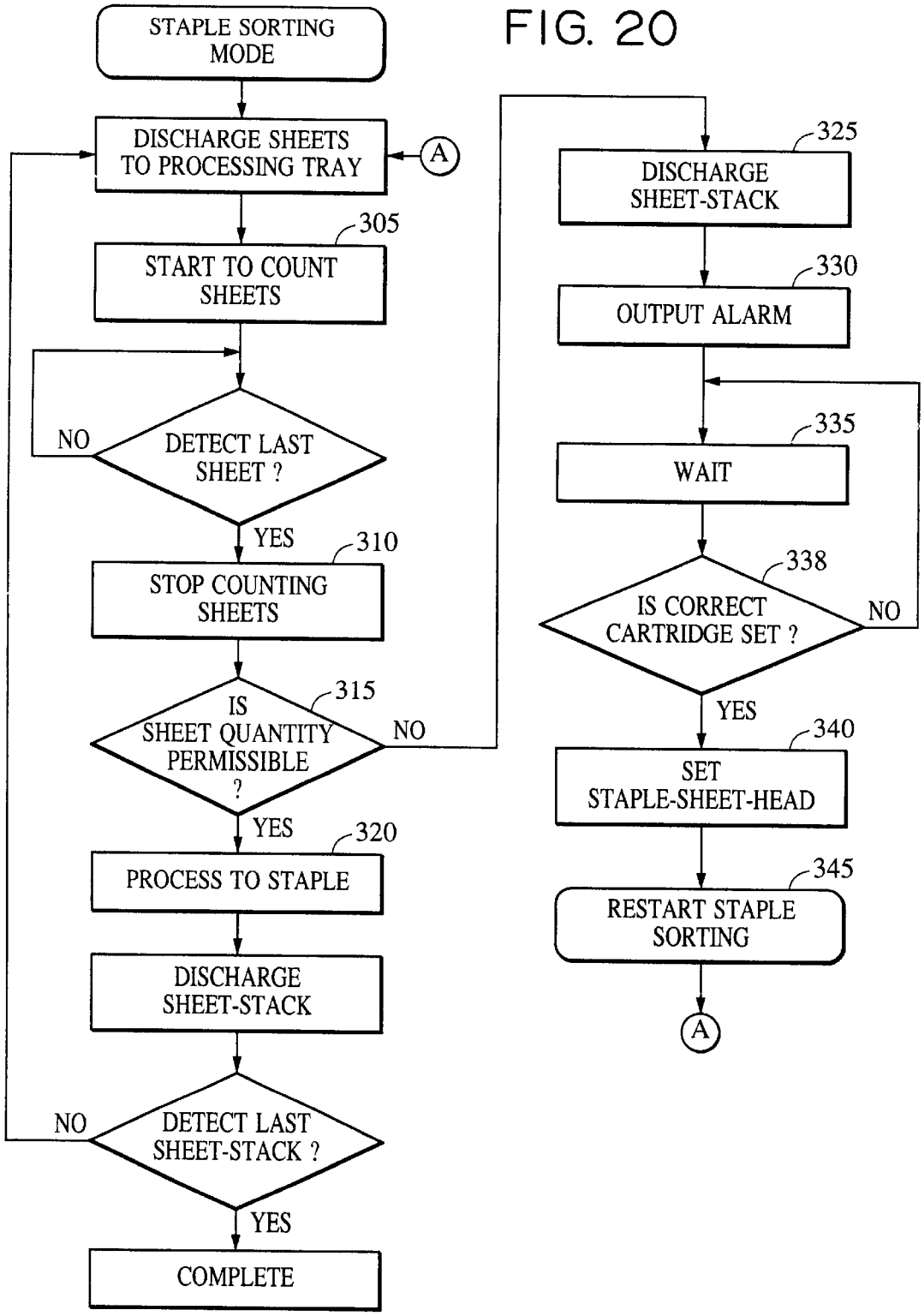
FIG. 20
STAPLE SORTING MODE
DISCHARGE SHEETS TO PROCESSING TRAY
A
305
START TO COUNT SHEETS
NO
DETECT LAST SHEET ?
YES
310
STOP COUNTING SHEETS
315
IS SHEET QUANTITY PERMISSIBLE ?
NO
YES
320
PROCESS TO STAPLE
DISCHARGE SHEET-STACK
NO
DETECT LAST SHEET-STACK ?
YES
COMPLETE
325
DISCHARGE SHEET-STACK
330
OUTPUT ALARM
335
WAIT
338
IS CORRECT CARTRIDGE SET ?
NO
YES
340
SET STAPLE-SHEET-HEAD
345
RESTART STAPLE SORTING
A

STAPLER WITH INTERCHANGEABLE CARTRIDGES

BACKGROUND OF THE INVENTION

1. Field of the Invention

The present invention relates to a stapler unit for binding a stack of sheets with staples and a sheet processing device for receiving sheets of paper and for binding a received stack of sheets by using the stapler unit.

2. Description of the Related Art

Hitherto, a stapler for automatically stapling a stack of sheets (hereinafter referred to as a sheet stack) has been provided with staples of only one length. When the sheet stack is thick, the staples do not pass through the sheet stack and the sheet stack is stapled incompletely. Therefore, a permissible value for the number of sheets is set, whereby a sheet stack having a number of sheets exceeding the permissible value is left unstapled.

A stapler is disclosed in, for example, Japanese Utility Model Publication No. 3-25931, which receives a detachable cartridge containing a plurality of staple sheets and drives the staples one by one from the staple sheets fed from the cartridge. This stapler is provided with staple sheets of staples having a predetermined length to be applied to a plurality of thicknesses of sheet stacks, and a cutter for cutting an excess part of each staple so as to improve the appearance when the staple protrudes excessively from a thinner sheet stack.

Various staple sorters and finishers have been devised as sheet processing devices. A finisher provided with the stapler disclosed in Japanese Utility Model Publication No. 3-25931 described above is disclosed in, for example, Japanese Patent Laid-Open No. 8-268640. Manipulation of cut-off staples in one of these devices is described below with reference to FIGS. 21A, 21B, and 21C.

A stapler 500 is provided with a shooter 500*b* at an end thereof for feeding cut-off staples from a predetermined position to a cut-off-staple hopper 500*c* included in the sheet processing device.

The cut-off staples are received by the hopper 500*c* via a slope 500*g* of a needle guide 500*f* when an aperture 500*d* of the shooter 500*b* is opened by being brought into contact with a protruding part 500*e* of the needle guide 500*f*.

The following problems have been found in the known device.

(1) Since staples of only one length are provided, the range of the permissible quantity of sheets to be included in one stack is limited.

(2) A cut-off-staple receiving part must be disposed outside the stapler. Therefore, the stapler must move translationally so as to smoothly transfer the cut-off staples to the cut-off-staple receiving part. Therefore, it is impossible to apply a staple inclined with respect to the edge of the sheet stack.

(3) Sheet stacks with a smaller quantity of sheets are processed more often than sheet stacks with a larger quantity of sheets. Therefore, cut-off staples are produced in almost every manipulation of sheet stacks, thereby contributing to environmental problems.

(4) The cut-off staples received by the cut-off-staple receiving part must be manually removed, which is burdensome. Moreover, the receiving state (quantity of received cut-off-staples) must be detected, thereby increasing the cost and size of the apparatus.

SUMMARY OF THE INVENTION

Accordingly, it is an object of the present invention to provide a stapler unit and a sheet processing device using the stapler unit, in which a sheet stack can be stapled without producing cut-off staples regardless of the quantity of stacked sheets.

To these ends, according to an aspect of the present invention, a stapler unit includes a stapler provided with a stapling device for stapling a sheet stack, and a staple cartridge arrangement detachably loaded on the stapler and provided with a staple receiving device for receiving staples. A plurality of the staple cartridges for receiving staples having different lengths are provided in the staple cartridge arrangement, and each of the staple receiving devices of the plurality of staple cartridges is provided with a guide for controlling, when the staple cartridge is loaded, staples received therein so that the longitudinal centers of the staples are positioned at the same positions as those of the staples having other lengths.

With this arrangement, the stapling device included in the stapler can be commonly used for staples of different lengths, and can staple a sheet stack of any quantity of sheets without producing cut-off pieces of staples.

The stapler is provided with a plurality of the staple cartridges for receiving staples having a plurality of lengths. An erroneous operation can be avoided in which a sheet stack having a greater or smaller thickness is processed with staples of a different size. This is possible by providing a -cartridge determining device for determining, when the staple cartridge is loaded, the length of each staple included in the staple cartridge being loaded.

A stapler unit according to the present invention can staple a sheet stack without producing cut-off pieces of staples regardless of the thickness of the sheet stack, whereby an additional device such as a staple cutter in the staple unit is not required. Therefore, the cost of the staple unit can be reduced, and an environmentally friendly product is provided.

An erroneous operation can be avoided in which a sheet stack having a greater or smaller thickness is processed with staples of a different size, by providing a cartridge determining device for determining, when the staple cartridge is loaded, the length of each staple included in the staple cartridge being loaded. With this arrangement, the reliability of the sheet processing device can be maintained, and devices such as a cut-off-staple receiving device and a sensor for detecting a cut-off-staple received state are not required, thereby reducing the cost and the size of the stapler unit.

Further objects, features and advantages of the present invention will become apparent from the following description of the preferred embodiments with reference to the attached drawings.

BRIEF DESCRIPTION OF THE DRAWINGS

FIG. 4 is a table showing the relationship between determination signals, detected cartridges, and permissible quantities of sheets in a stack according to the first embodiment;

FIG. 18 is a flowchart showing the operation in the staple-and-sort mode, according to the first embodiment;

FIG. 19 is a chart of the relationship between detection signals, detected cartridges, and permissible quantities of sheets of a sheet stack, according to a second embodiment of the present invention;

FIG. 20 a flowchart showing the operation in a staple-sorting mode, according to the second embodiment.

DESCRIPTION OF THE PREFERRED EMBODIMENTS

Figure 1:
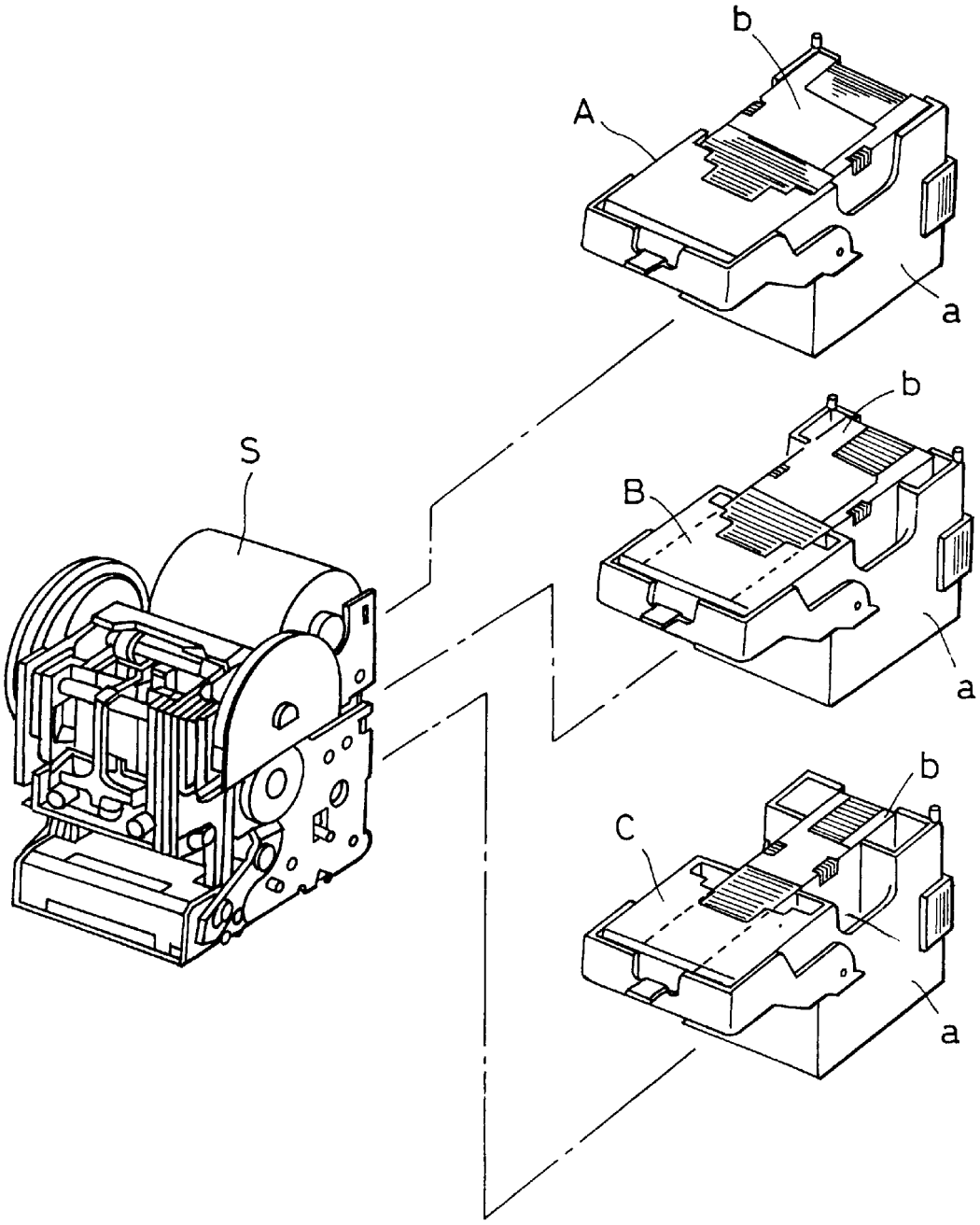
FIG. 1 is a perspective view of a stapler unit according to a first embodiment of the present invention.

FIG. 1 shows a stapler system according to a first embodiment of the present invention. The stapler system is configured with a stapler S, a staple cartridge A for receiving staples for stapling a stack of a maximum of 100 sheets, a staple cartridge B for receiving staples for stapling a stack of a maximum of 60 sheets, and a staple cartridge C for receiving staples for stapling a stack of a maximum of 20 sheets. The staple cartridges A, B, and C are provided with staples of different lengths loaded in each refill case b disposed in a cartridge frame a of the staple cartridge A, B, or C.

Figure 2:
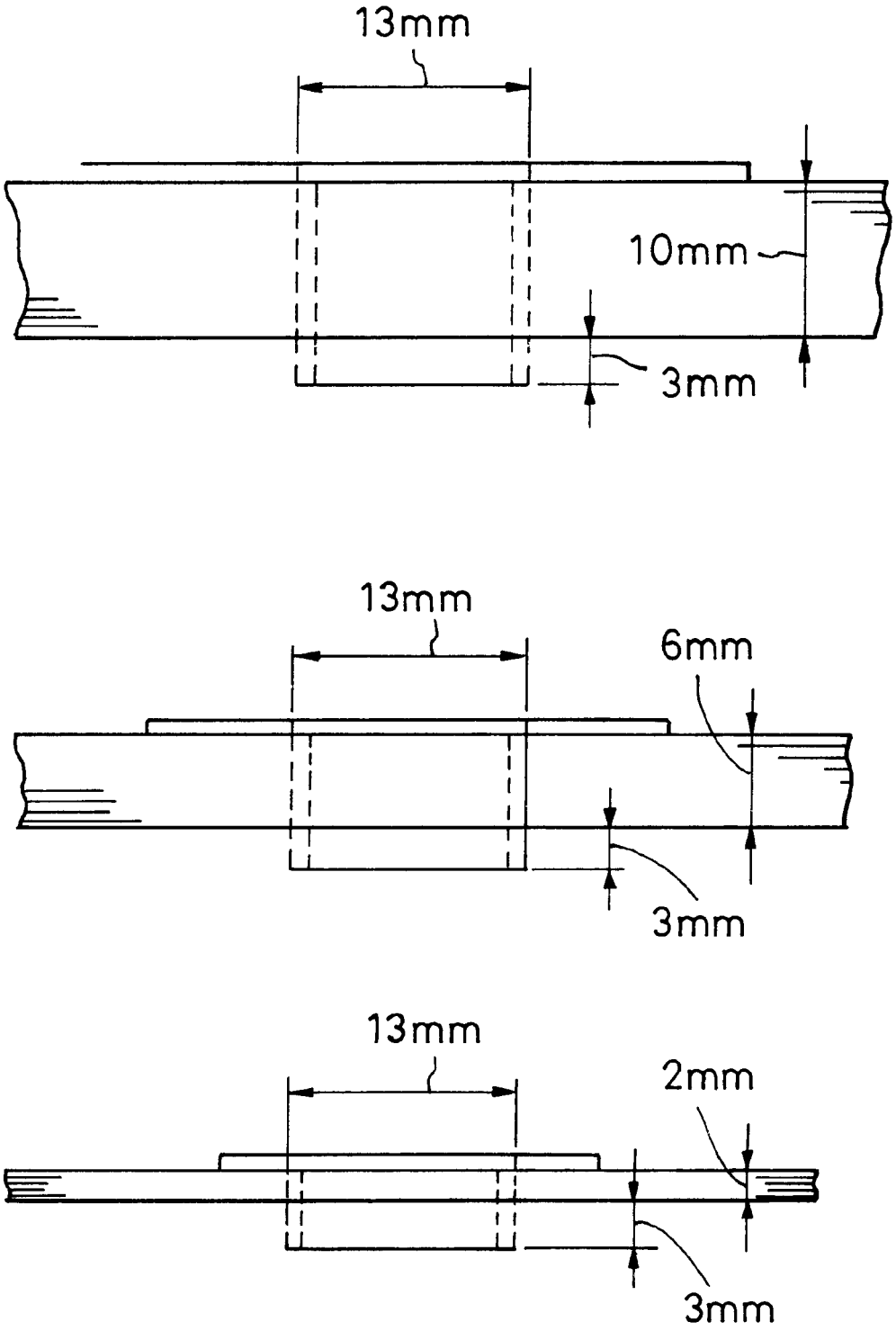
FIG. 2 is an illustration showing the length of staples used in the stapler unit according to the first embodiment.

As shown in FIG. 2, the length of each staple is set to the value described below in accordance with the maximum permissible quantity of sheets.

The length of a staple in the cartridge *A* is the crown (13 mm)+(stack thickness corresponding to 100 sheets (10 mm)+folded end (3 mm))×2=39 mm.

The length of a staple in the cartridge *B* is the crown (13 mm)+(stack thickness corresponding to sixty sheets (6 mm)+folded end (3 mm))×2=31 mm.

The length of a staple in the cartridge *C* is the crown (13 mm)+(stack thickness corresponding to twenty sheets (2 mm)+folded end (3 mm))×2=23 mm.

Figure 3A:
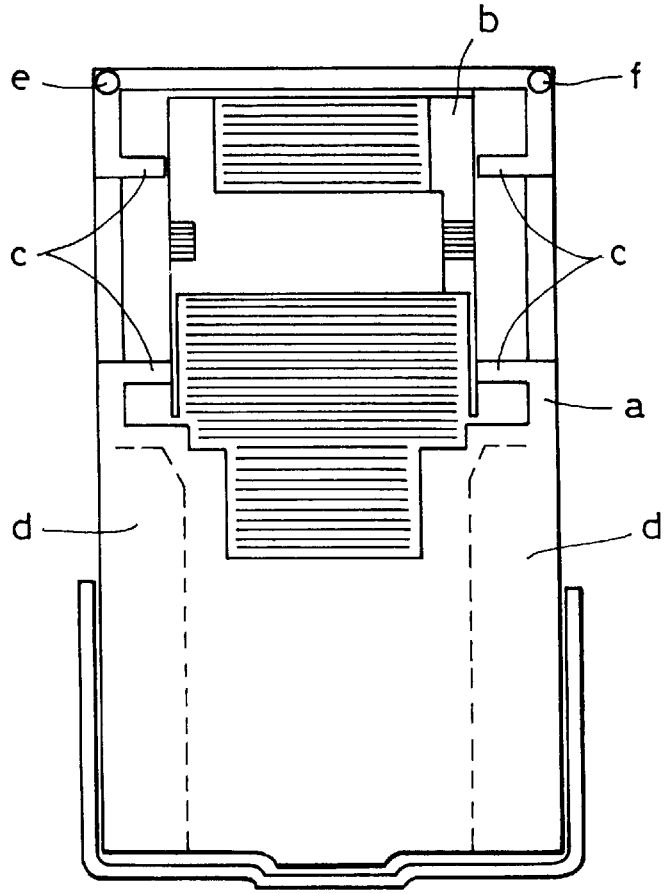
FIG. 3A is a bottom view of a staple cartridge used in the stapler unit according to the first embodiment.

FIG. 3A is a bottom view of the cartridge B. The cartridge B is provided with the cartridge frame a including ribs c for positioning the refill case b, and guide rails d for restricting the position of a staple sheet when transferred from the refill case b.

Figure 3B:
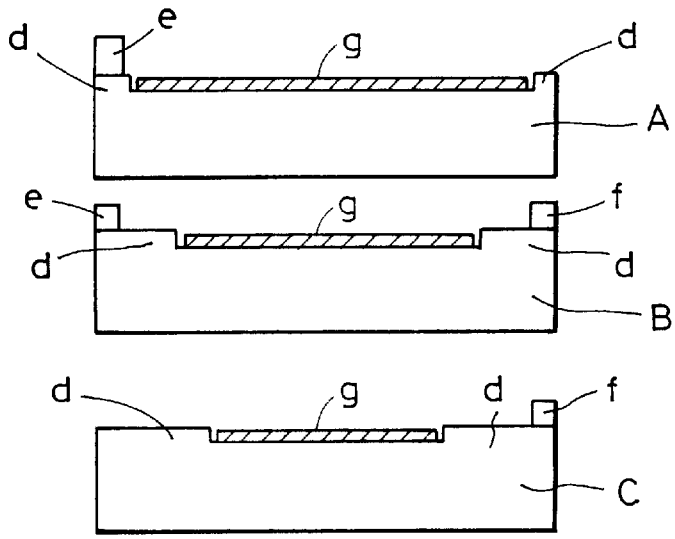
FIG. 3B is an illustration showing staple cartridges while being transferred.

FIG. 3B shows the cartridges A, B, and C viewed in the direction of the arrow shown in FIG. 3A, in which the positions of the staple sheets are restricted by the guide rails d so that the longitudinal centers g of the staples are at the same position.

Projections e and f disposed on the staple cartridge B shown in FIG. 3A form an identification mark for identifying the staple cartridge B. As shown in FIG. 3B, the projections e and f are disposed differently according to the cartridge A, B, or C. According to the present embodiment, switches SW1 and SW2 (see FIG. 9A) are disposed at the side of the stapler at the positions associated with the projections e and f of the cartridge, the switches SW1 and SW2 being used for determining the type of the staple cartridge and whether or not the staple cartridge is loaded, thereby outputting two types of signals according to the state of the staple cartridge. FIG. 4 shows the relationship between the output signals, detected cartridges, and permissible quantities of sheets of a sheet stack.

A sheet processing device using the above-described stapler system is described below.

Figure 5:
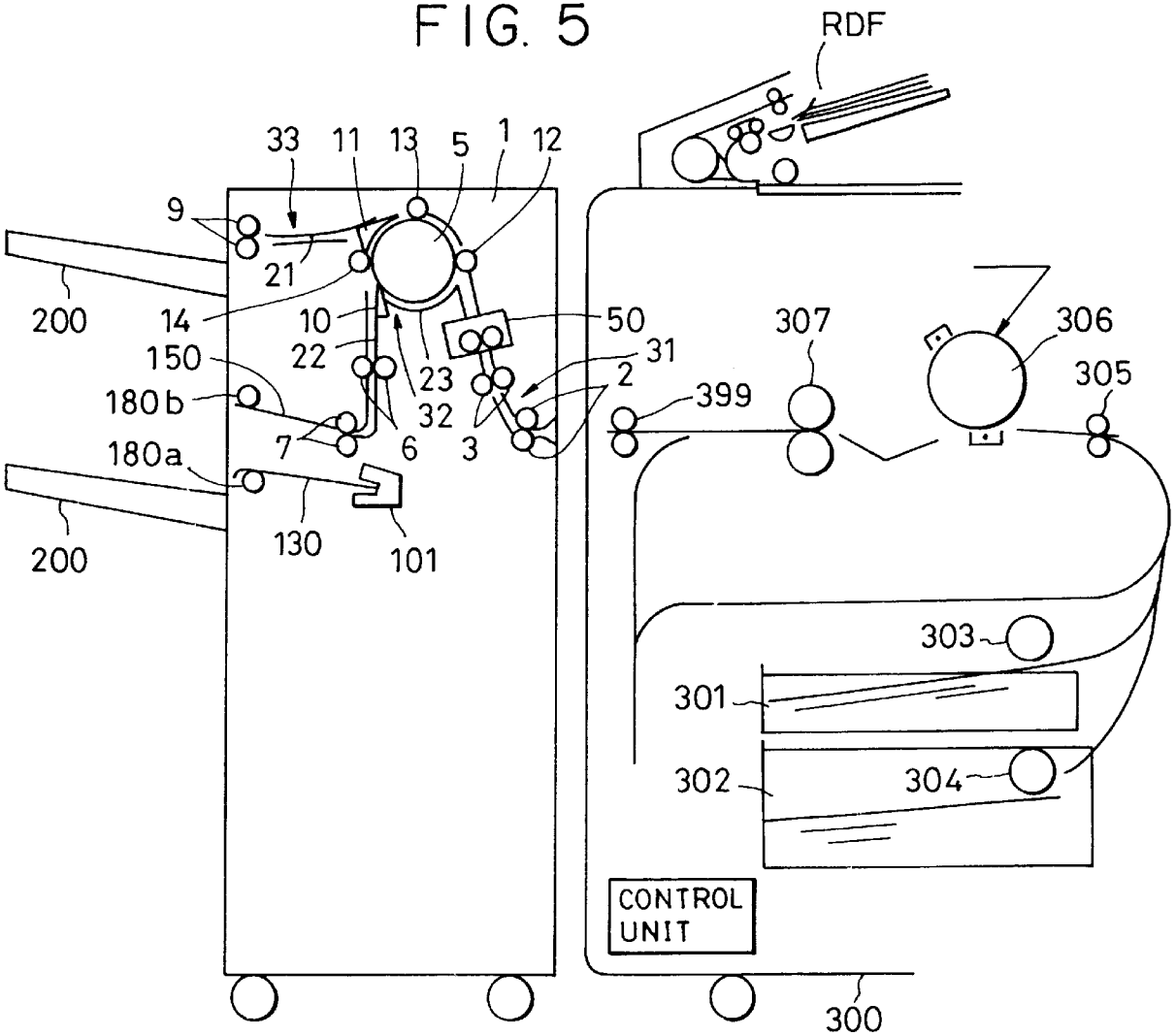
FIG. 5 is a front view showing the overall configuration of a sheet processing device according to the present invention.

In FIG. 5, a finisher 1 and an image forming apparatus 300 are shown. The image forming apparatus 300 includes cassettes 301 and 302, feeding rollers 303 and 304, a resist roller 305, an exposure drum 306, and a fixing roller 307. A detailed description of the image forming apparatus 300 and an RDF (recycle automatic document feeder) shown in FIG. 5 is omitted. Also shown in FIG. 5 are discharging rollers 399 of the image forming apparatus 300, inlet rollers 2 at the inlet of the finisher 1, conveying rollers 3, a sheet detector 31, a punching unit 50 for punching a sheet, while it is conveyed, at a position adjacent to the trailing end thereof, and a large conveying roller 5 for conveying the sheet while the sheet is being pressed by rollers 12, 13, and 14.

In FIG. 5, the finisher 1 includes a switching flapper 11 for switching between a non-sorting path 21 and a sorting path 22, and another switching flapper 10 for switching between the sorting path 22 and a buffer path 23 for temporarily storing sheets. The finisher 1 shown in FIG. 5 also includes conveying rollers 6, an intermediate tray 130 (hereinafter referred to as processing tray) for temporarily stacking, putting in order, and stapling sheets, discharging rollers 7 for discharging sheets onto the processing tray 130 (first stacking tray), a pivoting guide 150, and a sheet-stack discharging roller 180*b* (conveying unit) supported by the pivoting guide 150 for conveying and discharging a sheet stack on the processing tray 130 onto a stack tray (second stacking tray) 200 in cooperation with a roller 180*a* (conveying unit) disposed on the processing tray 130.

Figure 6:
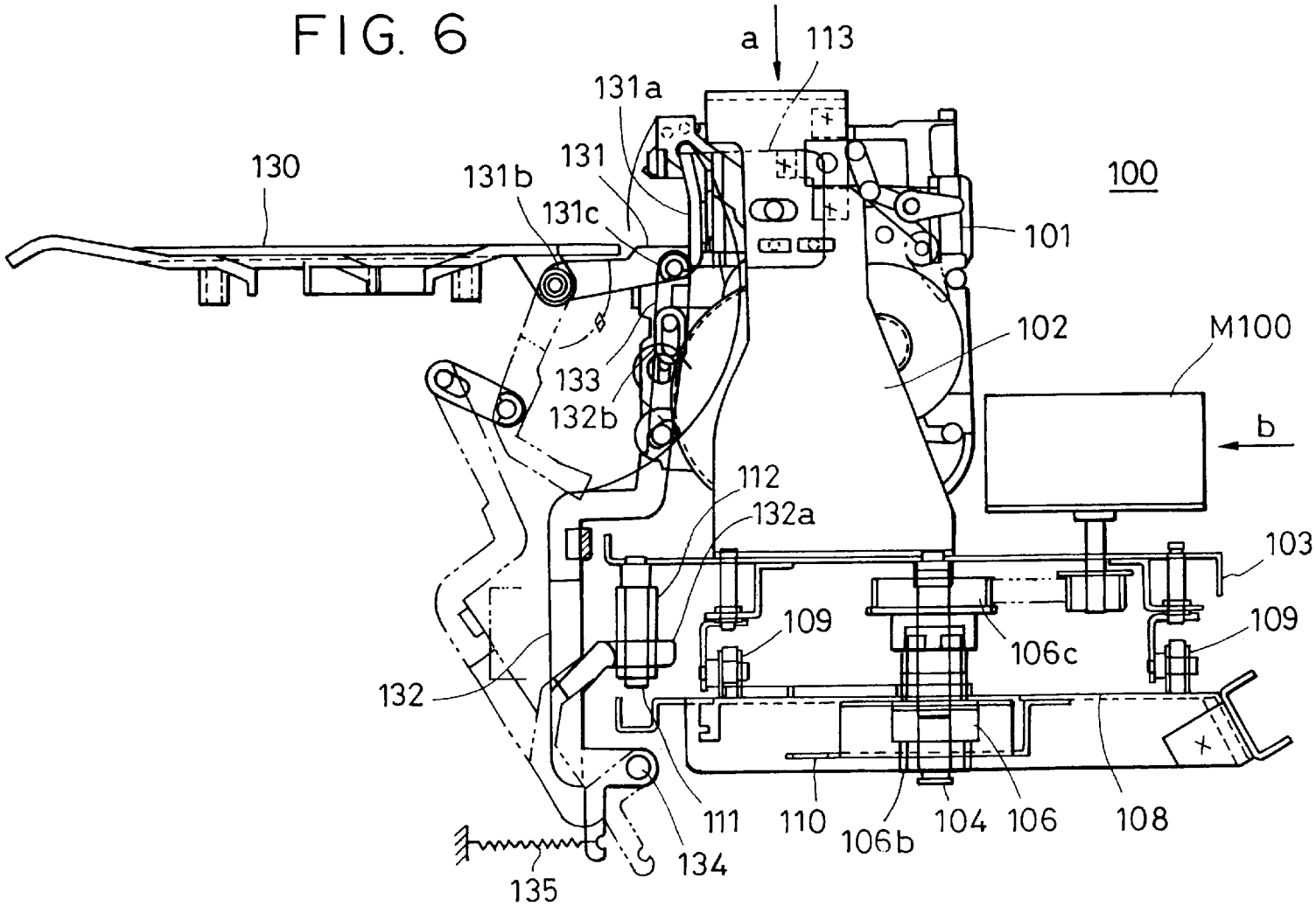
FIG. 6 is a side view of the stapler unit and a sheet processing tray.
Figure 7:
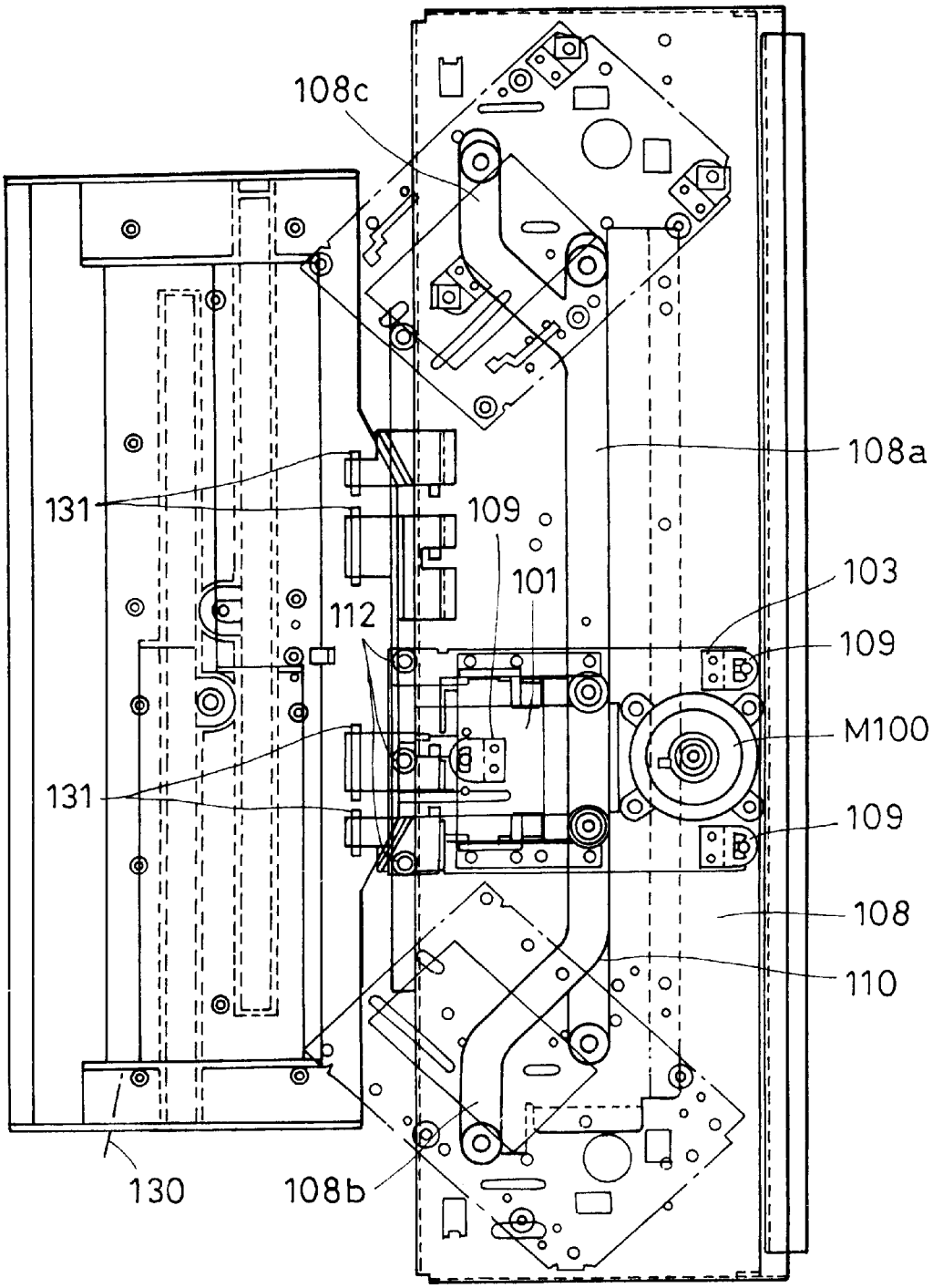
FIG. 7 is a plan view in the direction of an arrow a in FIG. 6 of a stapler transferring mechanism.
Figure 8:
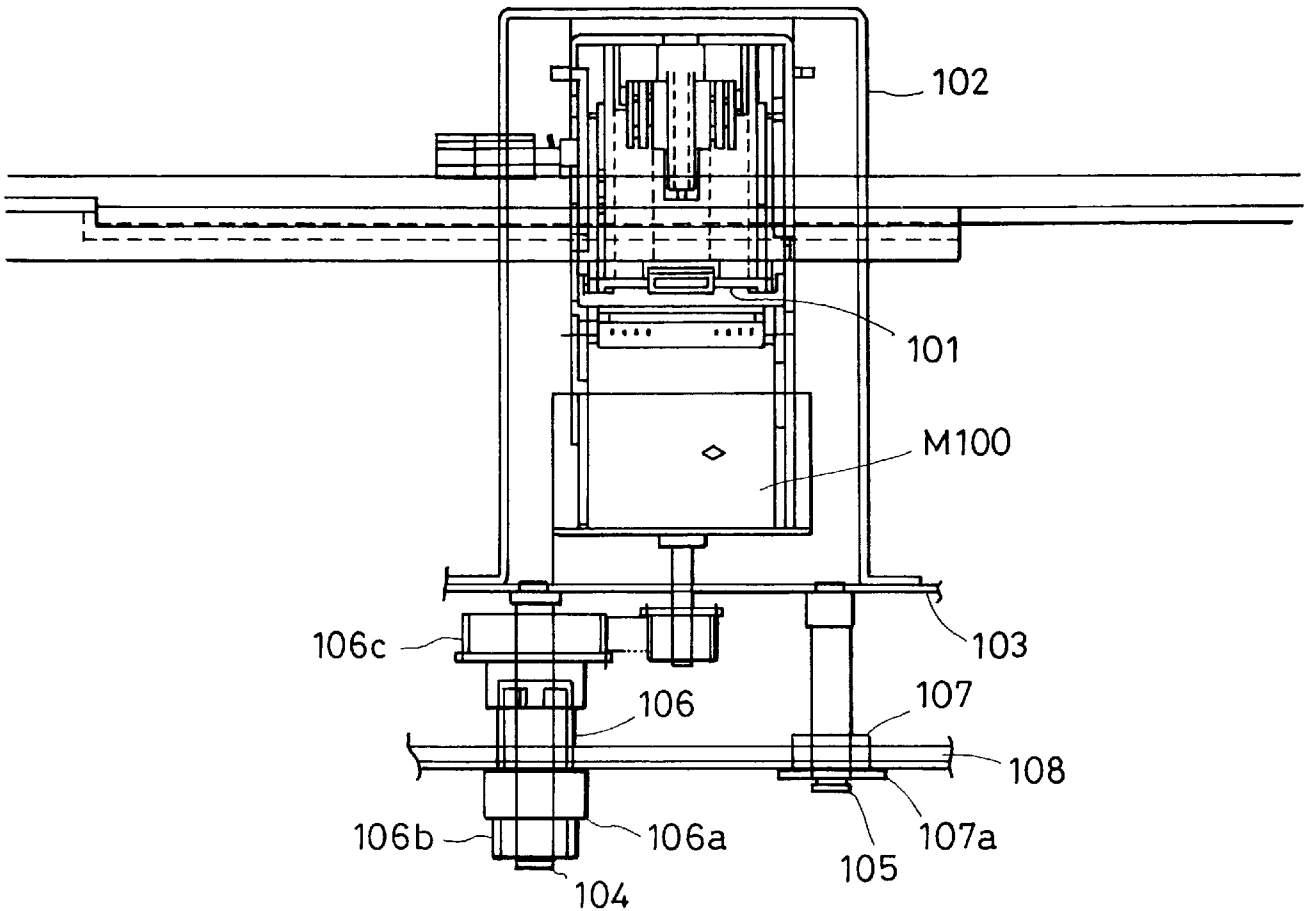
FIG. 8 is a rear view from in the direction of an arrow b of the stapler unit shown in FIG. 6.

With reference to FIGS. 6, 7, 8, 9A, 9B, and 9C, a stapler unit 100 is described. FIG. 6 is a section of the stapler unit 100. FIG. 7 is a view of the stapler unit 100 in the direction of an arrow a in FIG. 6. FIG. 8 is a view of the stapler unit 100 shown in FIG. 6 in the direction of an arrow b.

A stapler 101 for stapling is fixed to a moving frame 103 by a holder 102. Shafts 104 and 105 fixed to the moving frame 103 are provided with rollers 106 and 107 rotatably mounted thereon. The rollers 106 and 107 mate with guides 108*b* and 108*c*, respectively, which are formed in a fixed frame 108 by cutting away the fixed frame 108. The guides 108*b* and 108*c* overlap each other at longitudinal intermediate parts thereof to form a guide 108*a*.

The rollers 106 and 107 have flanges 106*a* and 107*a*, respectively, of which the diameter is larger than the width of the guides 108*a*, 108*b*, and 108*c*, whereby the moving frame 103 supporting the stapler 101 is movable on the fixed frame 108 along the guides 108*a*, 108*b*, and 108*c* without being disengaged therefrom. The moving frame 103, which is movable on the fixed frame 108, is supported by rollers 109 rotatably mounted on the moving frame 103.

The overlapped guides 108*b* and 108*c* are separated from each other toward the ends of each of the guides 108*b* and 108*c*. The guides 108*b* and 108*c* are parallel to each other toward the ends of each guide. With this arrangement, when the stapler 101 is positioned at the lower end of the guides in FIG. 7, the roller 106 mates with the guide 108*b* and the roller 107 mates with the guide 108*c* which extends straight from the guide 108*a*, whereby the stapler 101 is inclined, as shown in FIG. 7. When the stapler 101 is positioned at an intermediate part of each of the guides 108*b* and 108*c*, the rollers 106 and 107 mating with the guides 108*b* and 108*c*, respectively, are positioned in the overlapped guide 108*a*, whereby the stapler 101 is positioned horizontal, as shown in FIG. 7.

When the stapler 101 is positioned at the upper end of the guides in FIG. 7, the roller 106 mates with the guide 108*b* and the roller 107 mates with the guide 108*c*, whereby the stapler 101 is inclined in the direction opposite to the position of the stapler 101 when it is at the lower end of the guides.

The rollers 106 and 107 mating with the guides 108*b* and 108*c*, respectively, move along each guide, and the direction of movement of each roller is changed by cams (not shown).

The movement of the stapler 101 is described below.

A pinion gear 106*b* and a belt pulley 106*c* are formed integrally with the roller 106 of the moving frame 103. The pinion gear 106*b* is connected to a motor M100, disposed on the moving frame 103 and fixed thereto, via the pulley 106*c* and a belt. A rack gear 110 for mating with the pinion gear 106*b* is fixed to the bottom of the fixed frame 108 along the guides 108*a*, 108*b*, and 108*c*, whereby the moving frame 103 provided with the stapler 101 is driven back and forth by the motor M100 which is rotatable in both directions.

A stopper-pivoting roller 112 is provided on a shaft 111 extending downwardly from the bottom of the moving frame 103. The stopper-pivoting roller 112 pivots a trailing-end stopper 131 so that interference of the trailing-end stopper 131 with the stapler 101 is avoided.

The stapler unit 100 is provided with a sensor for detecting that the stapler 101 is at the home position. The stapler 101 generally waits at the home position which is a foremost position, according to the present embodiment.

Figure 9A:
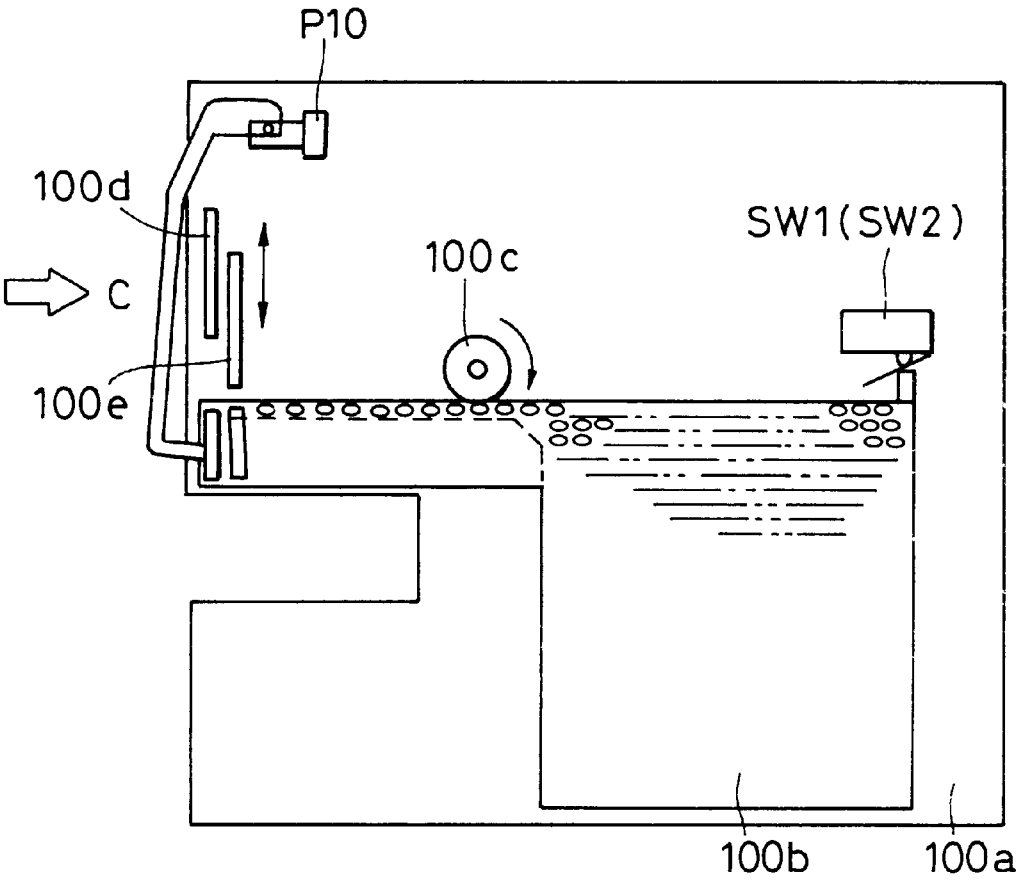
FIG. 9A is a sectional view of the stapler unit.

The stapler unit 100 is described more specifically as follows. FIG. 9A is a section of the stapler unit 100.

The stapler unit 100 includes a stapler 100*a* provided with a stapling device for stapling a sheet stack, a staple receiving device detachably mounted on the stapler 100*a* for receiving staples, and a staple cartridge 100*b* provided with a staple-transfer device for transferring staples to the stapling device of the stapler 100*a*. The staple cartridge 100*b* is loaded in the stapler 100*a*. A staple sheet including a plurality of staples is transferred to the left in FIG. 9A by a roller 100*c* driven by a driving source in the direction of the arrow in the drawing. The stapling device provided at the left side of the stapler unit includes a forming plate 100*e* and a driver 100*d* which are independently movable in the direction of the arrows in FIG. 9A. The forming plate 100*e* and the driver 100*d* form a staple and apply the staple one by one to be fed from the transferred staple sheet by being driven by a driving source. The stapler 100*a* is provided with the switches SW1 and SW2 fixed thereto for determining the type of the staple cartridge when the staple cartridge 100*b* is loaded and whether or not the staple cartridge is loaded, and a formed-staple detecting sensor P10 for determining whether or not a formed staple is prepared.

Figure 9B:
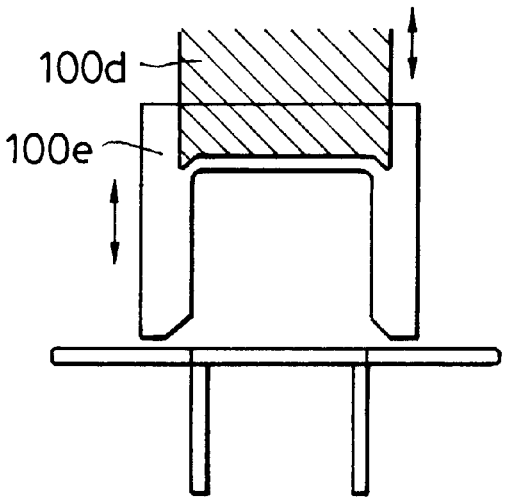
FIG. 9B is a side view in the direction of an arrow c of the stapler unit shown in FIG. 9A.
Figure 9C:
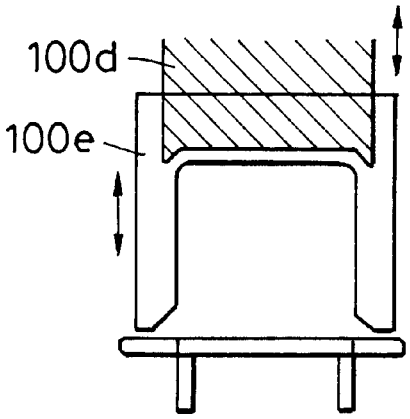
FIG. 9C is a side view from the arrow c of the stapler unit shown in FIG. 9A.

FIGS. 9B and 9C show the operation of the forming plate 100*e* and the driver 100*d* when viewed in the direction of an arrow C shown in FIG. 9A, in which forming and stapling can be performed regardless of the length of the staple.

The trailing-end stopper 131 for supporting the trailing end of sheets P loaded on the processing tray 130 is described below.

In FIG. 6, the trailing-end stopper 131 has a surface perpendicular to the loading surface of the processing tray 130, a supporting surface 131*a* for supporting the trailing ends of the sheets P, a pin 131*b* mating with a circular hole formed in the processing tray 130 for a pivoting motion, and a pin 131*c* to mate with a link which is described below. The link is configured with a main link 132 having a cam 132*a* to be in contact with and pressed by the stopper-pivoting roller 112 mounted on the stapler moving frame 103, and a connecting link 133 for connecting a pin 132*b* provided at the upper end of the main link 132 and the pin 131*c* of the trailing-end stopper 131.

The main link 132 pivots about a shaft 134 fixed to a frame (not shown). The main link 132 is provided with a spring 135 at the lower end of the main link 132 for urging the main link 132 clockwise. The main link 132 is positioned by a restricting plate, whereby the trailing-end stopper 131 is generally maintained perpendicular to the processing tray 130.

When the moving frame 103 moves, the stopper-pivoting roller 112 provided on the moving frame 103 pivots the trailing-end stopper 131 by pressing the cam 132*a* of the main link 132, whereby the trailing-end stopper 131 is pivoted by being pulled by the connecting link 133 to a position in which the trailing-end stopper 131 does not interfere with the stapler 101, otherwise the stapler 101 and the trailing-end stopper 131 interfere with each other. A plurality of the stopper-pivoting rollers 112 are provided so as to maintain the trailing-end stopper 131 in a position in which the interference can be avoided while the stapler 101 is moving. According to the present embodiment, three stopper-pivoting rollers 112 are provided.

The holder 102 of the stapler 101 is provided with staple stoppers 113 (shown by two-dot-chain lines in FIG. 6) at two sides of the holder 102, the staple stoppers 113 having supporting surfaces of the same shape as the supporting surface of the trailing-end stopper 131. With this arrangement, the trailing ends of sheets P can be supported by the staple stoppers 113 when the trailing-end stopper 131 is pivoted when the stapler 101 is disposed at an intermediate part of the guide 108*a*.

A processing tray unit 129 is described below with reference to FIG. 10.

The processing tray unit 129 is disposed between a transfer unit for transferring the sheets P from the image forming apparatus 300 and the stack trays 200 for receiving the sheet stacks processed on the processing tray 130.

The processing tray unit 129 is configured with the processing tray 130, the trailing-end stopper 131, an accommodation unit 140, a pivoting guide 150, a lead-in paddle 160, a protruding-withdrawing tray 170, and sheet-stack discharging rollers 180.

Figure 10:
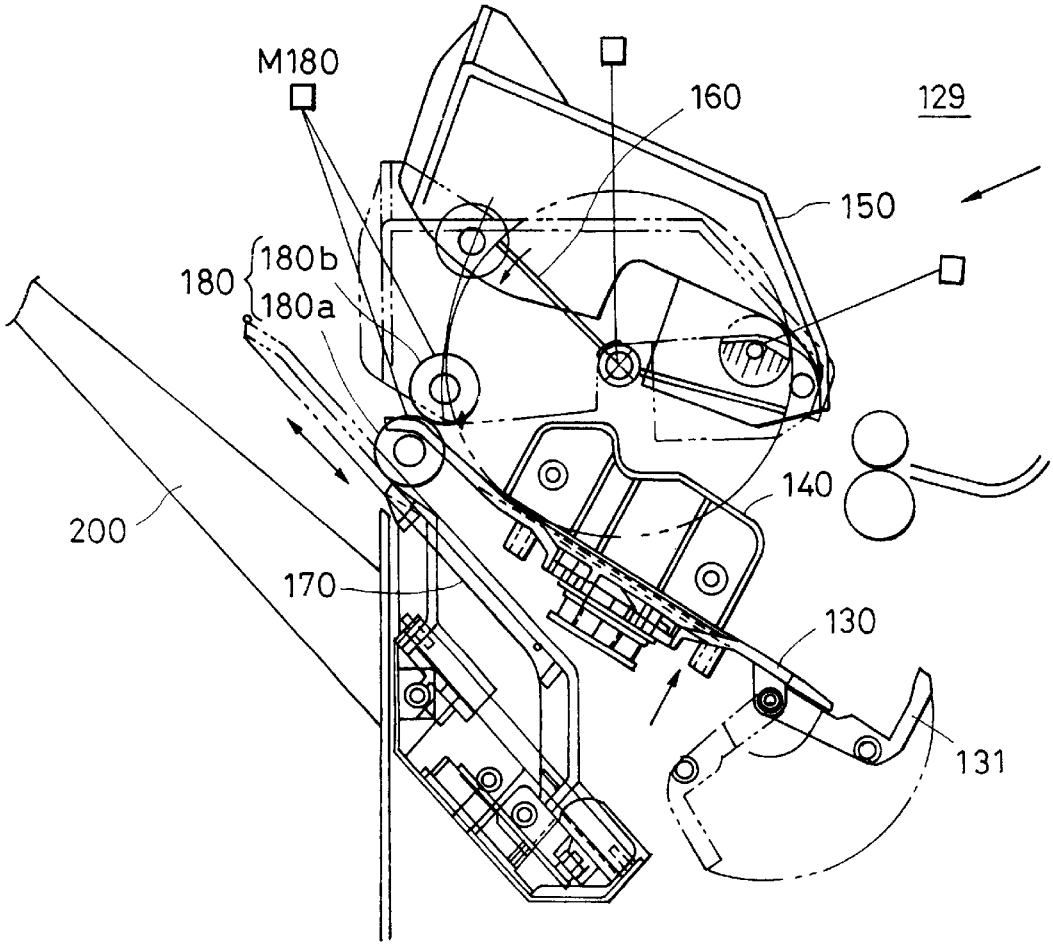
FIG. 10 is a longitudinal sectional side view of a pivoting guide and the processing tray.

The processing tray 130 is inclined so that the downstream side of the processing tray 130 is disposed upward (to the left in FIG. 10) and the upstream side thereof is disposed downward (to the right in FIG. 10). The trailing-end stopper 131 mates with the processing tray 130 at the lower end (upstream side) thereof. A sheet discharged by discharging rollers of the transfer unit slides on the processing tray 130 by its own weight and by the operation of the lead-in paddle 160 (described below) until the trailing end thereof comes into contact with the trailing-end stopper 131.

The processing tray 130 is provided with sheet-stack discharging rollers 180 at the upper end thereof. The pivoting guide 150 (described below) is provided with a sheet-stack discharging roller 180*b* attached thereto, the roller 180*b* being included in the sheet-stack discharging rollers 180 and being rotatable in both directions.

The flow of the sheets P is described below.

Figure 11:
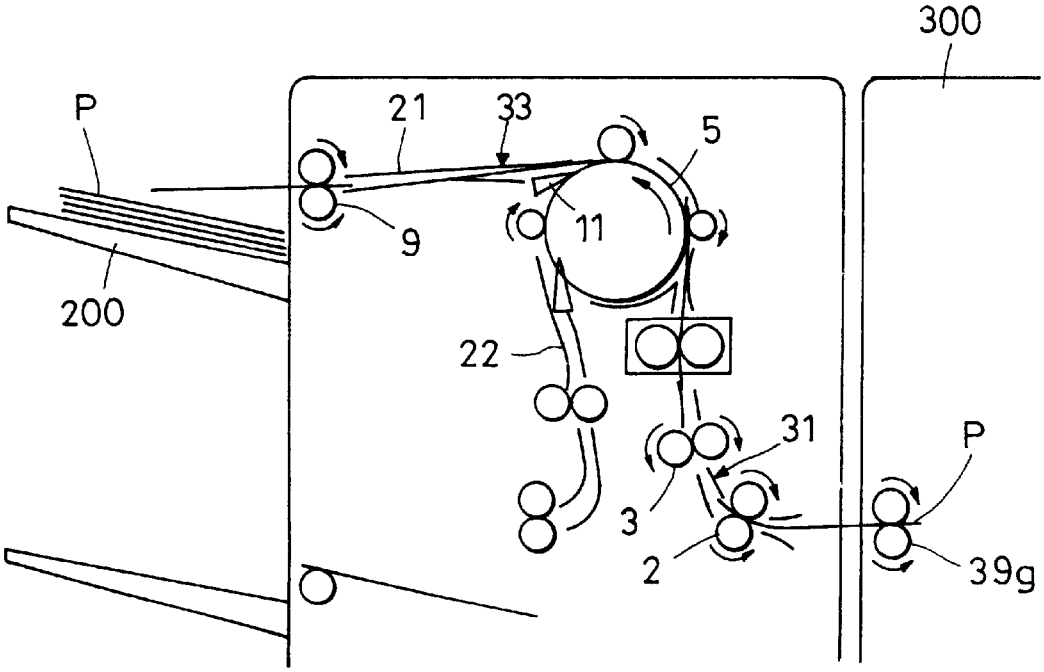
FIG. 11 is an illustration showing the operation of the sheet processing device in a non-sorting mode.

When the user designates the non-sorting mode through a control unit, the inlet rollers 2, the transfer rollers 3, and the large transfer-roller 5 rotate, as shown in FIG. 11, thereby transferring the sheets P transferred from the image forming apparatus 300. The switching flapper 11 pivots to the position shown in FIG. 11 by a solenoid (not shown), thereby transferring the sheets P to the non-sorting path 21. Rollers 9 discharge the sheets P to the stack tray 200 by rotating at a speed appropriate for loading in accordance with an output from a sensor 33 which detects the trailing end of the sheets P.

The operation in a staple-and-sort mode is described as follows.

Figure 12:
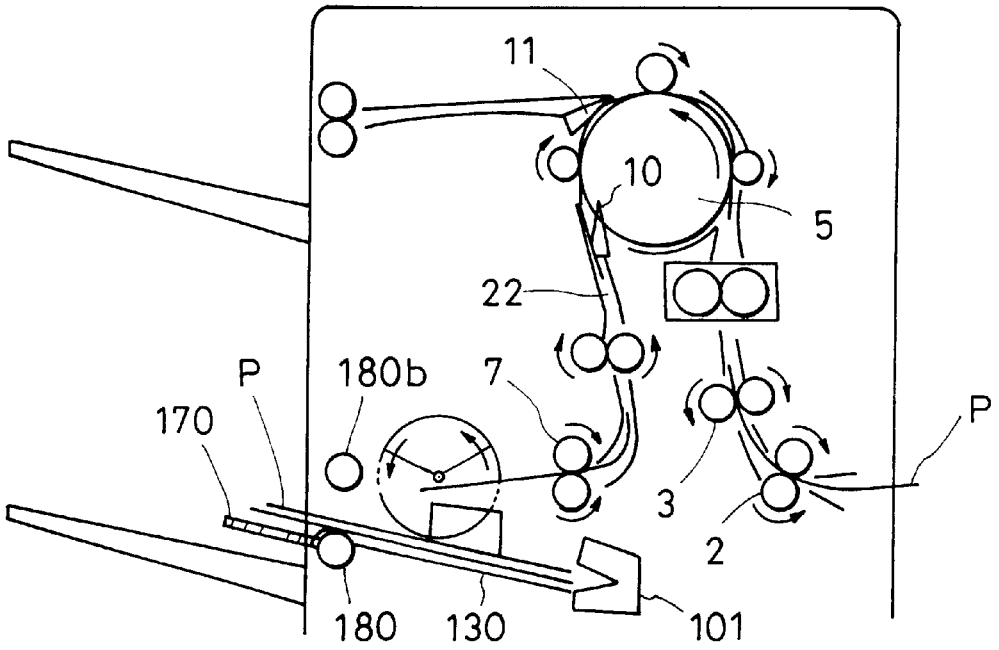
FIG. 12 is an illustration showing the operation of the sheet processing device in a staple-and-sort mode.

As shown in FIG. 12, the inlet rollers 2, the transfer rollers 3, and the large transfer-roller 5 rotate, thereby transferring the sheets P transferred from the image forming apparatus 300. The switching flappers 10 and 11 are disposed in switching positions shown in FIG. 12. The sheets P pass the sorting path 22 and are discharged to the stapler 101 by the discharging rollers 7. In this case, the protruding-withdrawing tray 170 is in a protruding state, thereby preventing the sheets P discharged by the discharging rollers 7 from hanging down at the leading end of the sheets P and being caught before sliding down to the trailing-end stopper 131, and thereby improving sheet accommodation on the processing tray 130.

The discharged sheets P start moving down to the trailing-end stopper 131 by their own weight, and the leadin paddle 160, having waited at the home position, rotates counter-clockwise by being driven by a motor M160, thereby assisting the movement of the sheets P. When the trailing ends of the sheets P come into contact with the trailing-end stopper 131 and stop moving, the lead-in paddle 160 stops rotating and a sheet accommodation device puts the sheets P in a correct position.

Figure 13:
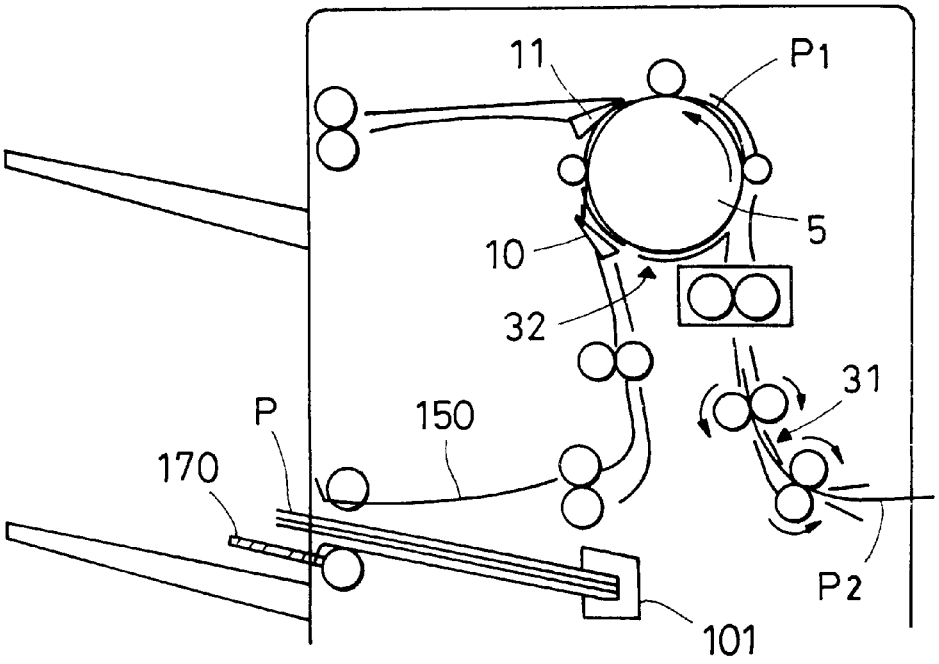
FIG. 13 is an illustration showing the operation of the sheet processing device in the staple-and-sort mode.

When a first set of sheets which is a stack of the sheets P are all discharged onto the processing tray 130 and put in the correct position, the pivoting guide 150 descends, the discharging roller 180*b* is applied to the sheet stack, and the stapler 101 staples the stack of sheets P, as shown in FIG. 13.

Figure 14:
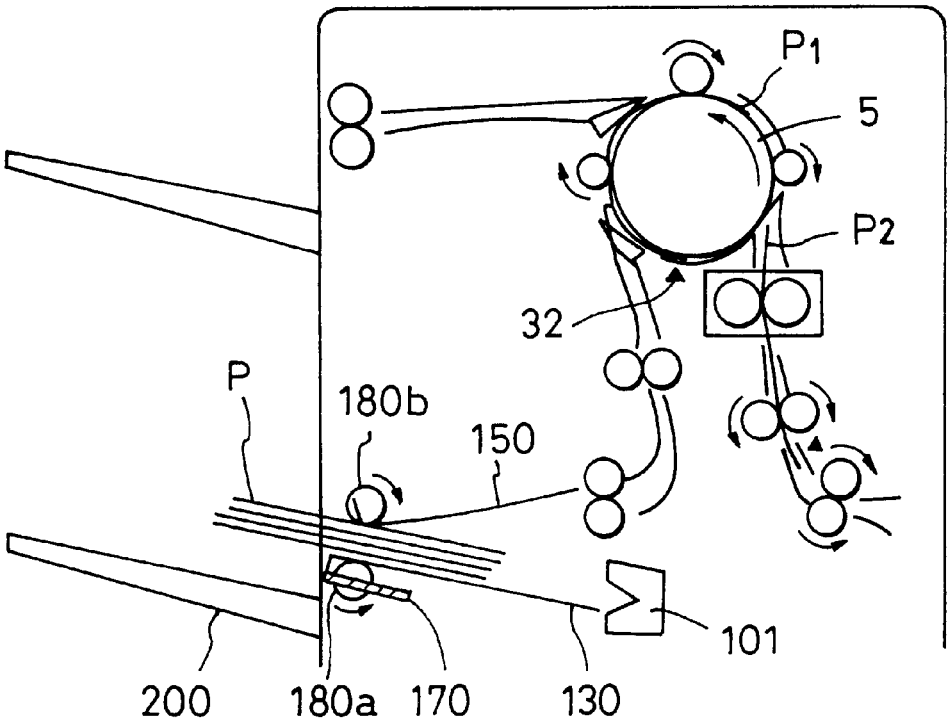
FIG. 14 is an illustration showing the operation of the sheet processing device in the staple-and-sort mode.
Figure 15:
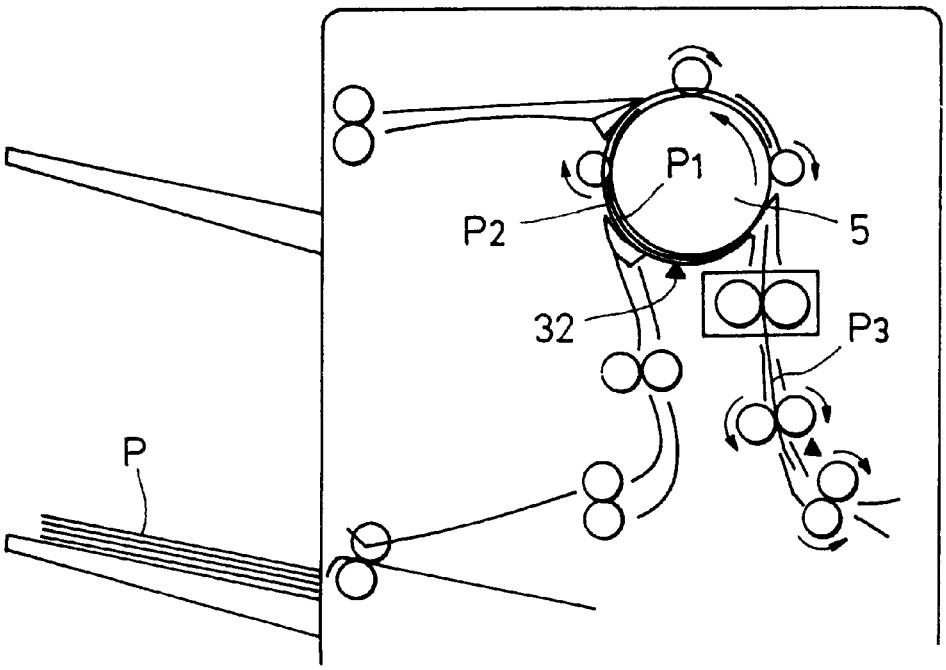
FIG. 15 is an illustration showing the operation of the sheet processing device in the staple-and-sort mode.

During this operation, another sheet P1 is discharged from the image forming apparatus 300, rolled on the large transfer roller 5 by a switching operation of the switching flapper 10, and stops at a predetermined distance from a sensor 32, as shown in FIG. 13. When another sheet P2 subsequent to the sheet P1 is transferred by a predetermined distance from a sensor 31, the large transfer roller 5 starts to rotate, as shown in FIG. 14, and the subsequent sheet P2 overlaps the sheet P1, the sheet P2 being disposed ahead of the sheet P1 by a predetermined distance. The overlapped sheets P1 and P2 are rolled on the large transfer roller 5, and stop at a predetermined position. The sheet stack on the processing tray 130 is discharged in a stack onto the stack tray 200, as shown in FIG. 15.

Figure 16:
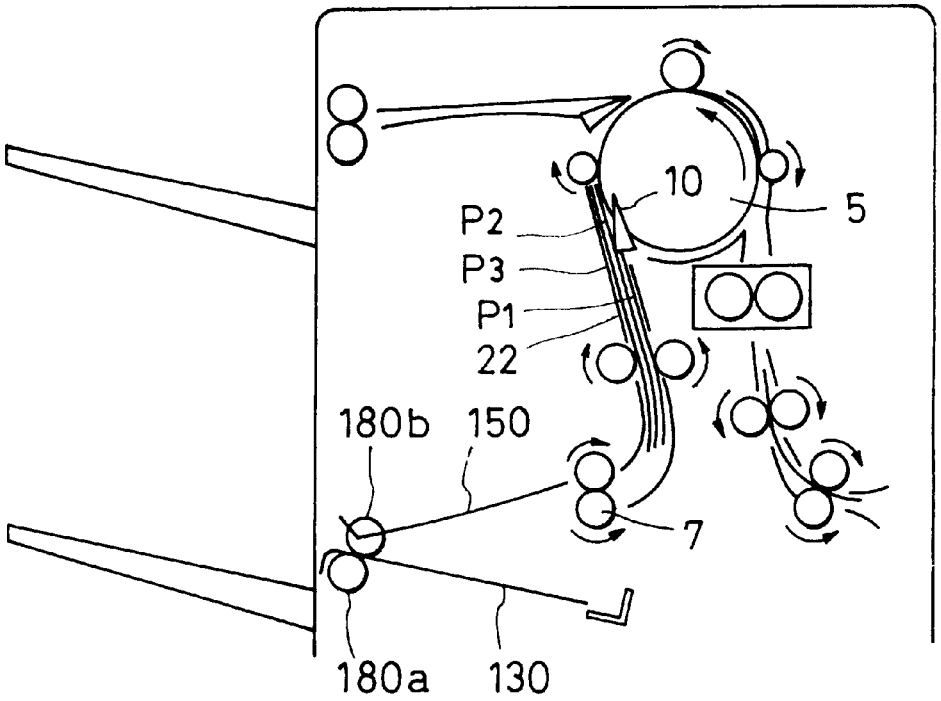
FIG. 16 is an illustration showing the operation of the sheet processing device in the staple-and-sort mode.

When discharging the sheet stack, the protruding-withdrawing tray 170 withdraws to the home position before the sheet stack separates from the sheet stack discharging rollers so as not to interfere with the falling of the sheet stack. In FIG. 16, when a third sheet P3 reaches a predetermined position, the large transfer roller 5 rotates, and the sheet P3 overlaps the sheet P2 which overlaps the sheet P1, the sheet P3 being disposed ahead of the sheet P2 by a predetermined distance. Then, the switching flapper 10 pivots so as to switch the three sheets P1, P2, and P3 toward the sorting path 22.

Figure 17A:
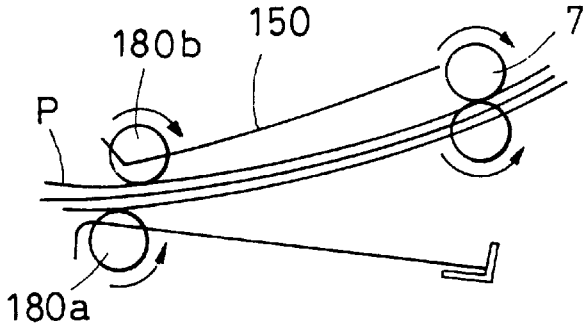
FIG. 17A is an illustration showing the operation of the sheet processing device in the staple-and-sort mode.
Figure 17B:
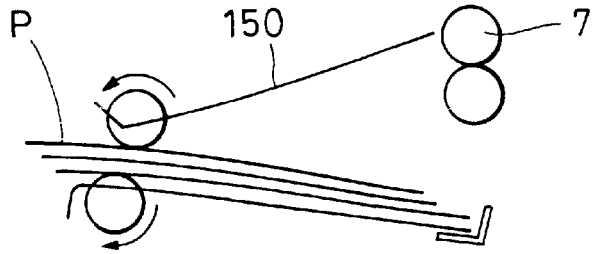
FIG. 17B is an illustration showing the operation of the sheet processing device in the staple-and-sort mode.
Figure 17C:
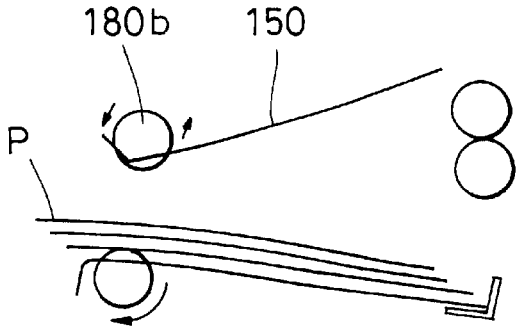
FIG. 17C is an illustration showing the operation of the sheet processing device in the staple-and-sort mode.

In FIG. 17A, the rollers 180*a* and 180*b* receive the three sheets P1, P2, and P3 when the pivoting guide 150 is at the lower position. In FIG. 17B, the rollers 180*a* and 180*b* rotate in the opposite direction after the trailing end of the sheet P1, P2, or P3 separates from the discharging rollers 7. In FIG. 17C, the pivoting guide 150 ascends and the roller 180*b* separates from the sheets P1, P2, and P3 before the trailing end of one of the sheets P1, P2, and P3 comes into contact with the trailing-end stopper 131. A fourth and subsequent sheets to be included in a second set are transferred through the sorting path 22 and discharged to the processing tray 130 in the same manner as the first set of sheets. A third and subsequent sets of sheets are, in the same manner, loaded onto the stack tray 200 in sets of a predetermined quantity of sheets, thereby completing the operation.

In the above-described transfer of a plurality of sheets overlapping each other, each subsequent sheet is offset from the preceding sheet in the direction of movement, the sheet P2 being offset from the sheet P1 and the sheet P3 being offset from the sheet P2 toward the downstream side.

Figure 17D:
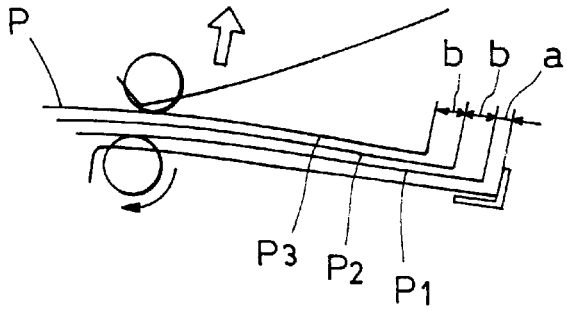
FIG. 17D is an illustration showing the operation of the sheet processing device in the staple-and-sort mode.
Figure 21A:
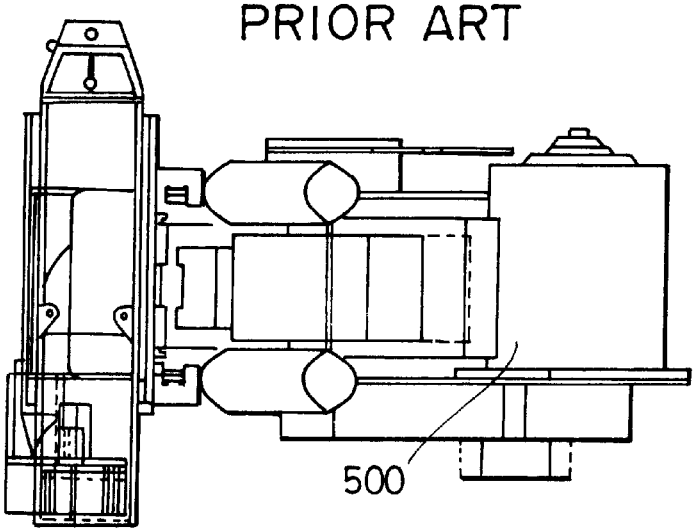
FIG. 21A PRIOR ART
FIGS. 21A, 21B, and 21C are illustrations of a known stapler.
Figure 21B:
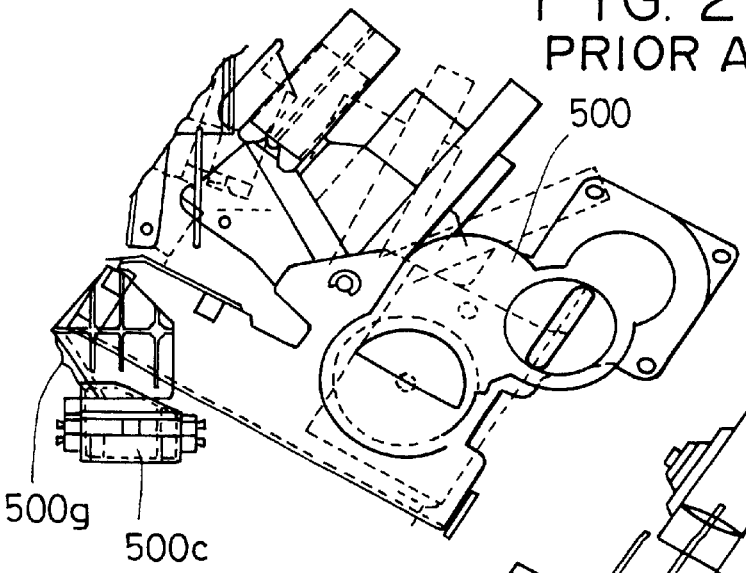
FIG. 21B PRIOR ART
Figure 21C:
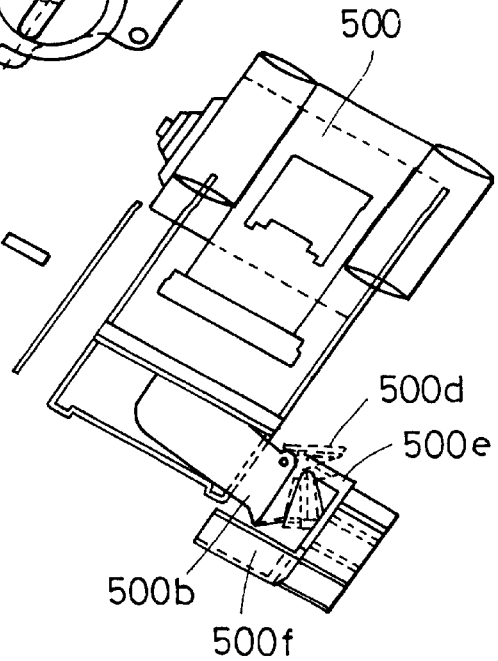
FIG. 21C PRIOR ART

The offset value and the timing of starting to raise the pivoting guide 150 depend on the time required for setting the sheets on the processing tray 130, that is, the speed of the reverse rotation of the rollers 180*a* and 180*b*, and also depend on the processing ability of the image forming apparatus 300. According to the present embodiment, offset b (see FIG. 17D) is set to approximately 20 mm and the sheet stack discharging roller 180*b* is set to separate from the sheets when a distance a (see FIG. 17D) between an end of the sheet P1 and the trailing-end stopper 131 is 40 mm or less, and the speed of transfer of the sheets is 750 mm/s and the speed of reverse rotation of the sheet stack discharging rollers 180 is 500 mm/s.

The operation in accordance with the above-described signals of the detected staple cartridge A, B, or C, or of the state in which no staple cartridge is detected is described below with reference to a detected-state table shown in FIG. 4 and a flowchart of the staple-and-sort mode shown in FIG. 18.

During the operation of discharging the sheets onto the processing tray 130, a counter for counting the quantity of sheets stacked on the processing tray 130 starts to count the quantity of sheets discharged to the processing tray 130 when the discharging starts (step 205), and stops counting when the last sheet of a set of sheets is discharged (step 210). A permissible quantity of sheets to be stapled and the quantity of the stacked sheets are compared (step 215), the permissible quantity of sheets to be stapled being obtained from the detected-state table according to the signal of the detected staple cartridge.

The quantity of sheets to be stacked is inputted either by counting the number of original documents or by directly inputting the quantity of sheets to be stacked. When the permissible quantity of sheets to be stapled is greater than or equal to the quantity of stacked sheets, the stacked sheets are stapled (step 220). When the permissible quantity of sheets to be stapled is less than the quantity of stacked sheets, the stacked sheets are discharged without being stapled (step 223), an alarm signal is given to the image forming apparatus side (step 225), and the operation is suspended in a waiting mode (step 230).

A message "too many sheets stacked" is displayed on the image forming apparatus for demanding exchange of the staple cartridge.

When the staple cartridge is exchanged and a different staple cartridge is loaded, in response to signals from the switches SW1 and SW2 (step 235), the head of a staple sheet is set to a proper position by an empty run until detecting a first staple of the staple sheet (step 240). When the correct staple cartridge corresponding to the quantity of the stacked sheets is loaded, the operation starts again automatically for stapling the sheet stacks which remain to be processed (step 245, A).

The operation based on signals of the detected staple cartridge, according to a second embodiment of the present invention, is described below with reference to a detected-state table shown in FIG. 19 and a staple-and-sort mode flowchart shown in FIG. 20.

During the operation of discharging the sheets onto the processing tray 130, a counter for counting the quantity of sheets stacked on the processing tray 130 starts to count the quantity of sheets discharged to the processing tray 130 when the discharging starts (step 305), and stops counting when the last sheet of a set of sheets is discharged (step 310). A permissible quantity of sheets to be stapled and the quantity of the stacked sheets are compared (step 315), the permissible quantity of sheets to be stapled being obtained from the detected-state table according to the signal of the detected staple cartridge.

The quantity of sheets to be stacked is inputted either by counting the number of original documents or by directly inputting the quantity of sheets to be stacked. When the condition (maximum permissible quantity of sheets to be stapled)≧(quantity of stacked sheets)≧(minimum permissible quantity of sheets to be stapled) is satisfied, the stacked sheets are stapled (step 320). When the condition (maximum permissible quantity of sheets to be stapled)<(quantity of stacked sheets)<(minimum permissible quantity of sheets to be stapled) is satisfied, the stacked sheets are discharged without being stapled (step 325), an alarm signal is given to the image forming apparatus side (step 330), and the operation is suspended in a waiting mode (step 335).

A message "too many or not enough sheets" is displayed on the image forming apparatus for demanding exchange of the staple cartridge.

When the staple cartridge is exchanged and a different staple cartridge is loaded, in response to signals from the switches SW1 and SW2 (step 338), the head of a staple sheet is set to a proper position by an empty run until detecting a first staple of the staple sheet (step 340). When the correct staple cartridge corresponding to the quantity of the stacked sheets is loaded, the operation starts again automatically for stapling the sheet stacks which remain to be processed (step 345, A).

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A stapler unit comprising:

a stapler including stapling means for stapling a sheet stack; and a staple cartridge assembly detachably loaded on the stapler and provided with staple receiving means for receiving staples, wherein the staple cartridge assembly includes a plurality of staple cartridges for receiving staples having different lengths, and each of the plurality of staple cartridges is provided with guide means for controlling, when the staple cartridge is loaded, the staples received therein, so that the longitudinal centers of the staples are positioned at the same positions as those of the staples having other lengths.

2. A stapler unit comprising:

a stapler provided with stapling means for stapling a sheet stack; and staple cartridge assembly detachably loaded on the stapler and provided with staple receiving means for receiving staples, wherein the staple cartridge assembly includes a plurality of staple cartridges for receiving staples having different lengths, and each of the plurality of staple cartridges including staples having different lengths is provided with cartridge determining means for determining, when the staple cartridge is loaded, the length of each staple included in the staple cartridge being loaded.

3. A sheet processing device comprising:

sheet receiving means for receiving sheets which have been transferred;

a stapler unit disposed so as to staple the sheets in the sheet receiving means, the stapler unit comprising a stapler provided with stapling means for stapling a sheet stack, and a staple cartridge assembly detachably loaded on the stapler and provided with staple receiving means for receiving staples, wherein the staple cartridge assembly includes a plurality of staple cartridges for receiving staples having different lengths, and each of the plurality of staple cartridges including staples having different lengths is provided with cartridge determining means for determining, when the staple cartridge is loaded, the length of each staple included in the staple cartridge being loaded;

sheet-quantity designating means for designating the quantity of sheets stacked in the sheet receiving means; and staple-process determining means for determining whether stapling is to be performed, in accordance with a signal from the cartridge determining means and the designation by the sheet-quantity designating means.

4. A sheet processing device according to claim 3, wherein the staple-process determining means determines that stapling is to be performed when the thickness of the sheet stack is not greater than that of a maximum permissible quantity of sheets to be stapled.

5. A sheet processing device according to claim 3, wherein the staple-process determining means determines that stapling is to be performed when the thickness of the sheet stack is equal to or smaller than that of a permissible quantity of sheets to be stapled.

6. A sheet processing device according to claim 5, wherein the permissible quantity of sheets to be stapled is equal to a maximum or minimum permissible quantity of sheets to be stapled or to a value therebetween.

7. A method of sheet processing using a sheet processing device comprising, sheet receiving means for receiving sheets which have been transferred;

a stapler unit disposed so as to staple the sheets in the sheet receiving means, the stapler unit comprising a stapler provided with stapling means for stapling a sheet stack, and a staple cartridge assembly detachably loaded on the stapler and provided with staple receiving means for receiving staples, wherein the staple cartridge assembly includes a plurality of staple cartridges for receiving staples having different lengths, and each of the plurality of staple cartridges including staples having different lengths is provided with cartridge determining means for determining, when the staple cartridge is loaded, the length of each staple included in the staple cartridge being loaded;

sheet-quantity designating means for designating the quantity of sheets stacked in the sheet receiving means; and staple-process determining means for determining whether stapling is to be performed, in accordance with a signal from the cartridge determining means and the designation by the sheet-quantity designating means, wherein the staple-process determining means determines that stapling is to be performed when the thickness of the sheet stack is not greater than that of a maximum permissible quantity of sheets to be stapled;

the method comprising the steps of:

suspending operation of the sheet processing device;

demanding exchange of staples when the thickness of the sheet stack is greater than that of the maximum permissible quantity of sheets to be stapled;

exchanging the staples in response to said demand step;

setting a first staple to a correct position when the exchanged staples are determined to be correct staples;

starting a subsequent sheet-stack processing.

8. A method of sheet processing using a sheet processing device comprising, sheet receiving means for receiving sheets which have been transferred;

a stapler unit disposed so as to staple the sheets in the sheet receiving means, the stapler unit comprising a stapler provided with stapling means for stapling a sheet stack, and a staple cartridge assembly detachably loaded on the stapler and provided with staple receiving means for receiving staples, wherein the staple cartridge assembly includes a plurality of staple cartridges for receiving staples having different lengths, and each of the plurality of staple cartridges including staples having different lengths is provided with cartridge determining means for determining, when the staple cartridge is loaded, the length of each staple included in the staple cartridge being loaded;

sheet-quantity designating means for designating the quantity of sheets stacked in the sheet receiving means; and staple-process determining means for determining whether stapling is to be performed, in accordance with a signal from the cartridge determining means and the designation by the sheet-quantity designating means, wherein the staple-process determining means determines that stapling is to be performed when the thickness of the sheet stack is equal to or smaller than that of a permissible quantity of sheets to be stapled; and wherein the permissible quantity of sheets to be stapled is equal to a maximum or minimum permissible quantity of sheets to be stapled or to a value therebetween;

the method comprising the steps of:

suspending the operation of the sheet processing device;

demanding the exchange of staples when the thickness of a sheet stack is other than that of the permissible quantity of sheets to be stapled;

exchanging the staples in response to said demand step;

setting a first staple to a correct position when the exchanged staples are determined to be correct staples; and starting a subsequent sheet-stack processing.

9. An image forming apparatus comprising:

a sheet processing device comprising:

sheet receiving means for receiving sheets which have been transferred;

a stapler unit disposed so as to staple the sheets in the sheet receiving means, the stapler unit including a stapler provided with stapling means for stapling a sheet stack, and a staple cartridge arrangement detachably loaded on the stapler and provided with staple receiving means for receiving staples, wherein the staple cartridge arrangement includes a plurality of staple cartridges for receiving staples having a plurality of lengths, and each of the plurality of staple cartridges including staples having different lengths is provided with cartridge determining means for determining, when the staple cartridge is loaded, the length of each staple included in the staple cartridge being loaded;

sheet-quantity designating means for designating the quantity of sheets stacked in the sheet receiving means; and staple-process determining means for determining whether stapling is to be performed, in accordance with a signal from the cartridge determining means and the designation by the sheet-quantity designating means;

wherein the staple-process determining means determines that stapling is to be performed when the thickness of the sheet stack is not greater than that of a maximum permissible quantity of sheets to be stapled; and wherein operation of the sheet processing device is suspended and the exchange of staples is demanded when the thickness of the sheet stack is greater than that of the maximum permissible quantity of sheets to be stapled, the staples are exchanged, a first staple is set to a correct position when the exchanged staples are determined to be correct staples, and a subsequent sheet-stack processing is started.

10. An image forming apparatus comprising:

a sheet processing device comprising:

sheet receiving means for receiving sheets which have been transferred;

a stapler unit disposed so as to staple the sheets in the sheet receiving means, the stapler unit comprising a stapler provided with stapling means for stapling a sheet stack, and staple cartridge assembly detachably loaded on the stapler and provided with staple receiving means for receiving staples, wherein the staple cartridge assembly includes a plurality of staple cartridges for receiving staples having different lengths, and each of the plurality of staple cartridges including staples having different lengths is provided with cartridge determining means for determining, when the staple cartridge is loaded, the length of each staple included in the staple cartridge being loaded;

sheet-quantity designating means for designating the quantity of sheets stacked in the sheet receiving means; and staple-process determining means for determining whether stapling is to be performed, in accordance with a signal from the cartridge determining means and the designation by the sheet-quantity designating means;

wherein the staple-process determining means determines that stapling is to be performed when a thickness of the sheet stack is equal to or smaller than that of a permissible quantity of sheets to be stapled;

wherein the permissible quantity of sheets to be stapled is equal to a maximum or minimum permissible quantity of sheets to be stapled or to a value therebetween; and wherein operation of the sheet processing device is suspended and the exchange of staples is demanded when the thickness of the sheet stack is other than that of the permissible quantity of sheets to be stapled, the staples are exchanged, a first staple is set to a correct position when the exchanged staples are determined to be correct staples, and a subsequent sheet-stack processing is started.

* * * * *

UNITED STATES PATENT AND TRADEMARK OFFICE

CERTIFICATE OF CORRECTION

PATENT NO. : 6,474,633 B1
DATED : November 5, 2002
INVENTOR(S) : Katsuaki Hirai

It is certified that error appears in the above-identified patent and that said Letters Patent is hereby corrected as shown below:

Column 3,
Line 49, “20” should read -- 20 is --.

Column 7,
Line 55, “leadin” should read -- lead-in --.

Signed and Sealed this

Sixth Day of May, 2003

JAMES E. ROGAN
*Director of the United States Patent and Trademark Office*